US010096898B2

(12) United States Patent
Nikitin et al.

(10) Patent No.: US 10,096,898 B2
(45) Date of Patent: Oct. 9, 2018

(54) SELF-RECONFIGURABLE ANTENNA

(71) Applicant: INTERMEC, INC., Lynnwood, WA (US)

(72) Inventors: Pavel Nikitin, Seattle, WA (US); Stephen J. Kelly, Marion, IA (US)

(73) Assignee: INTERMEC, INC., Lynnwood, WA (US)

( * ) Notice: Subject to any disclaimer, the term of this patent is extended or adjusted under 35 U.S.C. 154(b) by 95 days.

(21) Appl. No.: 14/985,634

(22) Filed: Dec. 31, 2015

(65) Prior Publication Data

US 2017/0201018 A1 Jul. 13, 2017

(51) Int. Cl.

| | |
|---|---|
| ***H01Q 3/24*** | (2006.01) |
| ***H01Q 15/14*** | (2006.01) |
| ***H01Q 9/06*** | (2006.01) |

(52) U.S. Cl.

CPC ..... *H01Q 3/24* (2013.01); *H01Q 9/065* (2013.01); *H01Q 15/14* (2013.01)

(58) Field of Classification Search

None

See application file for complete search history.

(56) References Cited

U.S. PATENT DOCUMENTS

| | | | | |
|---|---|---|---|---|
| 7,071,791 | B1 | 7/2006 | Wilson, III | |
| 7,199,719 | B2 | 4/2007 | Steinberg | |
| 8,532,211 | B2 | 9/2013 | Filipovic et al. | |
| 8,967,485 | B2 | 3/2015 | Piazza et al. | |
| 9,705,183 | B2 * | 7/2017 | Nikitin | H01Q 1/245 |
| 2007/0279225 | A1 | 12/2007 | Pellerano et al. | |
| 2010/0327766 | A1 * | 12/2010 | Recker | H02J 9/02 315/291 |
| 2012/0050015 | A1 * | 3/2012 | Low | G06K 7/10158 340/10.1 |
| 2012/0062366 | A1 | 3/2012 | Pappu et al. | |

(Continued)

OTHER PUBLICATIONS

Jens Masuch "An RF-to-DC energy harvester for co-integration in a low-power 2.4 GHz transceiver frontend", 2012 IEEE, pp. 680-683.*

(Continued)

*Primary Examiner* — Trinh Dinh

(74) *Attorney, Agent, or Firm* — Oliff PLC; R. Brian Drozd

(57) ABSTRACT

A passive, self-reconfigurable antenna device, components of a corresponding wireless network, and methods pertaining to operations and controls of the antenna device are provided. The antenna device can include at least one antenna element configured to receive a modulated or unmodulated wireless signal, a power harvester configured to obtain power from the modulated or unmodulated wireless signal, and a first switch coupled to the power harvester and powered by the obtained power from the power harvester. The first switch can be configured to operate automatically when receiving the obtained power without requiring the receipt of control information. Further, the first switch can be configured to automatically operate according to one or more predetermined operating patterns when receiving the obtained power to modulate the corresponding antenna element. This way, antenna operating frequency, or radiation pattern or polarization states can be reconfigured.

20 Claims, 6 Drawing Sheets

(56) References Cited

U.S. PATENT DOCUMENTS

| | | | | |
|---|---|---|---|---|
| 2014/0375501 | A1* | 12/2014 | Nikitin | H01Q 1/245 342/367 |
| 2015/0091706 | A1 | 4/2015 | Chemishkian et al. | |
| 2015/0105032 | A1* | 4/2015 | Wang | H03K 17/161 455/77 |
| 2016/0020637 | A1* | 1/2016 | Khlat | H02J 7/025 320/108 |
| 2017/0162261 | A1* | 6/2017 | Chevallier | G11C 13/0035 |
| 2017/0200020 | A1* | 7/2017 | Nagata | G06F 21/6227 |
| 2017/0309994 | A1* | 10/2017 | Nikitin | H01Q 21/005 |

OTHER PUBLICATIONS

Xiao Lu "Wireless Networks with RF Energy Harvesting: A Contemporary Survey" , Sep. 5, 2014; pp. 1-34.*

May 22, 2017 Search Report issued in European Patent Application No. 16206842.3.

* cited by examiner

SELF-RECONFIGURABLE ANTENNA

BACKGROUND

Smart antennas and reconfigurable antennas have been used in applications for wireless network communications including communications via radio-frequency identification (RFID) tags and Wi-Fi and provide many beneficial features. However, they are overly complex and expensive to make and use. Smart antennas, which are also known as adaptive array antennas and multiple-input multiple-output (MIMO) antennas, are highly adaptable devices that use complex algorithms and modifiable antenna configurations to communicate effectively on a wireless network. However, these highly adaptable devices require external variable power to support their adaptable configurations, which include changing their antenna configurations, performance and other parameters as needed.

Smart antennas also operate with phase distribution system controls that manage a phased array of antenna devices cooperating with each other to steer radio beams and adapt to network parameters as needed for effective network communications. However, such networks and devices are expensive. Further, they are complicated to design, manage and maintain due to the multiple changeable components required in the antenna devices, not to mention due to the complexity of their control mechanisms that ensure coordinated control of the antenna elements, as well as their need for external variable power requirements.

Reconfigurable antennas likewise include modifiable elements that permit antenna configuration changes to be made, but the antenna device itself in these systems is more compact than with smart antennas. Similar to smart antennas, reconfigurable antennas can be electronically switched as needed to enable and disable communications and modify antenna parameters. Conventional reconfigurable antennas include variable resistors in the form of PIN diodes and small switches in the form of micro-electro-mechanical system (MEMS) switches, which are controlled to modify the antenna configurations.

Both smart and reconfigurable conventional antennas require external variable power supplies and DC bias lines in order to provide power for changing their configurations, as well as for supporting their complex logic elements and control mechanisms. Both of these conventional antenna systems also require complex circuitry and support features, such as fiber optic lines, DC biased RF feeds, and other complex circuitry components. As such, conventional smart and reconfigurable conventional antennas require complicated antenna designs, complex controls and elaborate control logic for managing the devices, as well as external variable power supplies to enable their operation.

SUMMARY

Various configurations of a passive, self-reconfigurable antenna device and method for operating and controlling the antenna device are provided. The antenna device can include at least one antenna element configured to receive a modulated or an unmodulated wireless signal, a power harvester configured to obtain power from the modulated or unmodulated wireless signal, and a first switch coupled to the power harvester and powered by the obtained power from the power harvester. The first switch can be configured to operate automatically when receiving the obtained power without requiring the receipt of control information. Further, the first switch is configured to automatically switch between operating positions according to a predetermined pattern when receiving the obtained power from the power harvester to modulate the corresponding antenna element.

Advantages and features of novelty characterizing aspects of the invention are pointed out with particularity in the appended claims. To gain an improved understanding of advantages and features of novelty, however, reference can be made to the following descriptive matter and accompanying figures that describe and illustrate various configurations and concepts related to the invention.

BRIEF DESCRIPTION OF THE DRAWINGS

Examples of a reconfigurable antenna device are illustrated in the figures. The examples and figures are illustrative rather than limiting.

DETAILED DESCRIPTION OF THE EMBODIMENTS

Described in detail below are example configurations of an antenna device for communicating on a wireless network, which is self-powered and self-reconfigurable, and operates efficiently without requiring complex controls and independent power sources. The antenna device includes a power harvester that obtains power from a wireless signal at the local antenna element and thereafter automatically operates without requiring control inputs or receiving external control data. As such, without needing to receive a control signal or control data, the antenna device is configured to be self-powered and operate as soon as it begins receiving power via the power harvester.

Figure 1:
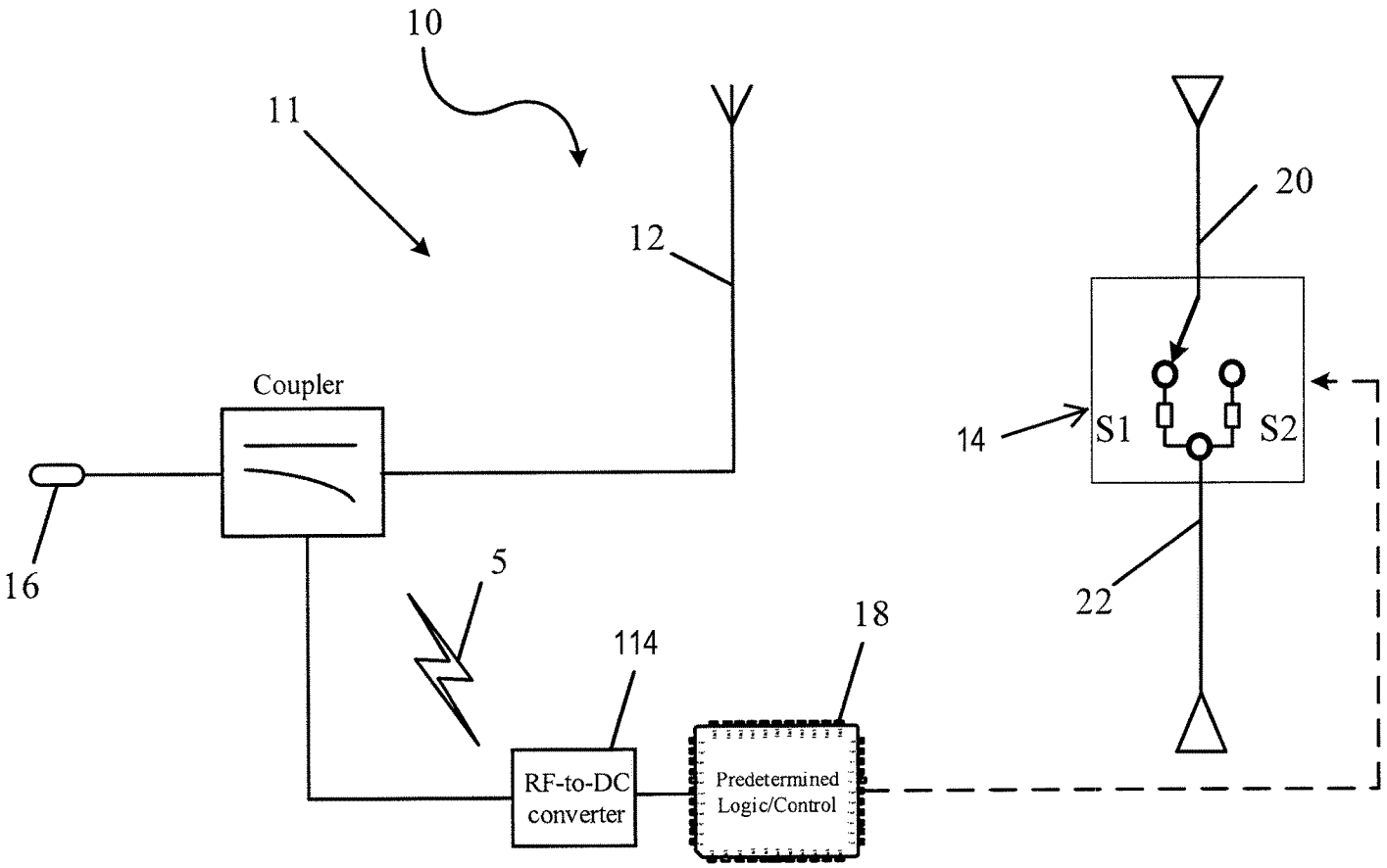
FIG. 1 shows an example antenna device having features for enabling it to be self-powered and self-reconfigurable without complex control mechanisms or an external variable power supply.

General operation and basic features of a self-powered, self-reconfigurable antenna device, according to one embodiment, is illustrated in FIG. 1. FIG. 1 shows a central control circuit 11 of an antenna device 10 having a main antenna element 12 (e.g. a dipole) connected with a first switch 14 and an input port 16 of the antenna device. First switch 14 is generally configured as a radio-frequency identification (RF-ID) switch 14 that operates as a power harvester 14 to convert RF energy from the wireless, modulated or unmodulated signal 5 received by antenna element 12. First switch 14 is configured to operate automatically when receiving power obtained by the power harvester without requiring reception of control information. As such, the first switch is configured to operate automatically when receiving the obtained power, and to operate to repeatedly turn the antenna device on and off according to a predetermined rate of recurrence.

Antenna device 10 including first switch 14 is coupled to the power harvester and powered by the obtained power of the power harvester 14. Further, antenna device 10 is configured to operate automatically when receiving obtained power from the harvester without requiring the reception of control information. The antenna device 10 further includes a control logic device 18 that controls the switching of switchable elements 20 and 22. The logic part can be as complex as a programmable microcontroller that generates and sends commands to switchable elements 20 and 22, or it can be as simple as a pulse generator driving a counter, which turns switchable elements 20 and 22 on and off in a certain order (e.g., similar to "LED chaser" circuit) or predetermined pattern.

Current low power RF technology already allows one to create RF powered switches that can be turned on and off individually by the control signal. Good examples of such switches are UHF antenna device ICs, which have passive RF sensitivity better than −20 dB and unique IDs. These devices can modulate their input impedance between two values, such as staying in a low impedance state for as long as 25 ms, which is the duration currently dictated by the RFID protocol details and on-chip capacitance standards.

As such, RF switches like RF switch 14 shown in FIG. 1 on the wirelessly reconfigurable antenna can be similar in structure to RFID integrated circuits (ICs). Such switches can be formed as custom ICs or as discrete circuits with low power microcontrollers, similar to configurations for discrete UHF antenna devices.

Figures 2A, 2B:
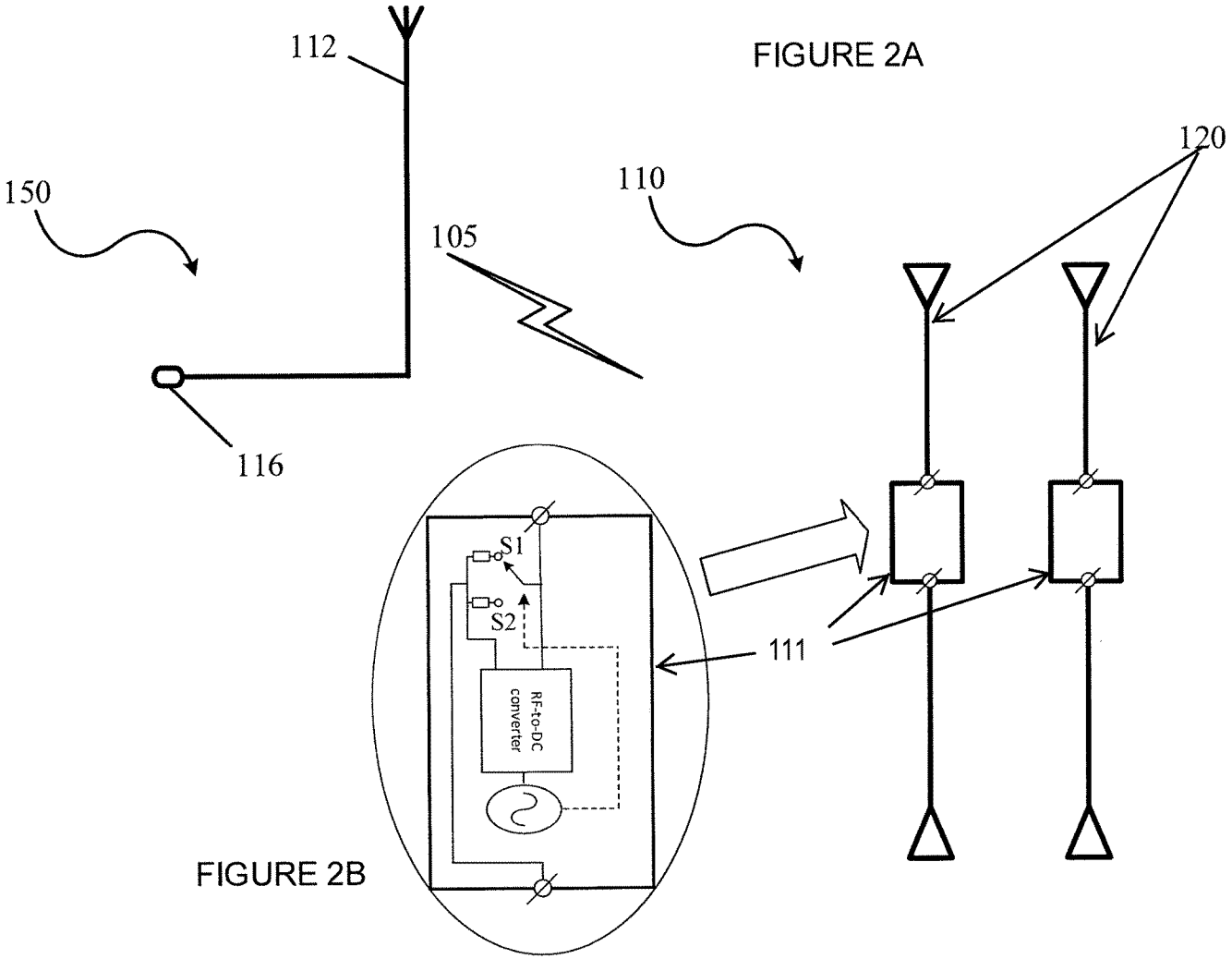
FIG. 2A shows another example antenna device with a different configuration than FIG. 1.
FIG. 2B shows an exemplary circuit for the example antenna device of FIG. 1.

Referring now to FIGS. 2A and 2B (collectively referred to herein as FIG. 2 or FIG. 2), another configuration of an antenna device 150 is shown that can include several distributed, self-powered control circuits configured similar to control circuit 111 shown in FIG. 2, but which are each connected with an antenna element 120. Antenna element 120 can be a parasitic element or it can be part of the main antenna element. Such circuits can be set, for example, to different oscillating periods, resulting in the antenna switching between many states.

The switching characteristics of each antenna element 120 are predetermined so the antenna device can begin operating automatically as soon as it receives power. The predetermined switching characteristics can include how often control circuit 111 switches between several beam patterns, which can be fixed or set in advance based on the design of hardware components in the circuit as a predetermined pattern. Although fixed via hardware, these settings can be configured for manual adjustment using, for example, variable capacitors on the circuit that an operator can fine tune as needed. Further, the switching characteristics can also be controlled by the level or intensity of input power received, or the frequency of the modulated or unmodulated wireless signal 105 it receives, which can be achieved by using threshold circuits and/or filters that, depending on the frequency and power of the signal applied to the antenna, change the switching characteristics or the antenna configuration (e.g., its radiation pattern, operating frequency, polarization, etc.). Thus, many predetermined patterns can exist for controlling the switching characteristics depending on variable inputs (e.g., level or intensity of input power received) and predetermined characteristics, such as one or more predetermined patterns that are selected based on variable inputs, such as power level received.

Nonetheless, the switching characteristics and antenna configuration for the antenna device 150 and control circuit 111 are pre-determined operating parameters that are configured prior to operation of the device. This eliminates the need for the device to receive a control signal and control data in order to determine these parameters, and also eliminates the need for complex control mechanisms to determine and change these parameters, as well as eliminating the need for externally powered mechanisms to enable making configuration changes. As such, antenna device 110 can be formed as an inexpensive, very lower power device, which can nevertheless re-configure itself according to predetermined parameters and patterns. Such reconfiguration operations can be provided via the use of multiple predetermined sets of parameters as noted above that can be selected when the antenna device is used based on variable parameters, such as the frequency of the wireless signal provided, its intensity and/or other parameters. Further, the predetermined sets of parameters and patterns for controlling the same during use can be modified, such as via manual changes to variable hardware components like variable capacitors.

In addition, multiple switching and antenna parameter options can be provided based on the combinations of predetermined parameters occurring during operation of the antenna device. For instance, input port 116, control circuit 111, antenna element 112, and RF-to-DC converter/power harvester 114 shown in FIG. 2 operate similar to input port 16, control circuit 11, antenna element 12 and converter/power harvester 114 shown in FIG. 1. As such, main control circuit 111 cycles between on and off modes during operation according to the resonant frequency of the circuit set by converter/power harvester 114. As such, the antenna devices 10 and 150 can operate under at least two (2) sets of antenna and/or switching parameters simply based on the on/off state of primary switch 14 in the main circuit for the device. The addition of various other switching and antenna parameter options at the switching elements described along with FIG. 2, and/or selectable parameter options based on features such as the frequency or intensity of the wireless signal, can provide numerous predetermined operating states based on their combinations. Further, reconfiguration of the antenna device based on combinations of the predetermined parameters can be implemented without requiring a control signal, transmission of control data or complex control components.

In addition, the self-reconfigurable functionality of the antenna devices 10 and 110 are not limited to operational parameters of the devices. For example, visual feedback parameters could also be predetermined according to operating states of the device and pre-integrated into it as additional operating parameters. For instance, visual feedback can be provided that indicates the state of the antenna device, such as having several LEDs mounted on it and being RF-powered from the same circuitry that feeds antenna switching digital logic. These LEDs can be sequentially turned on (e.g., like "chaser lights") to indicate which radiation pattern lobe is currently activated and thus indicate to the user the direction in which the antenna main beam is pointing or other configuration information. This is especially useful for RFID reader antennas regardless whether handheld or fixed.

Figure 3:
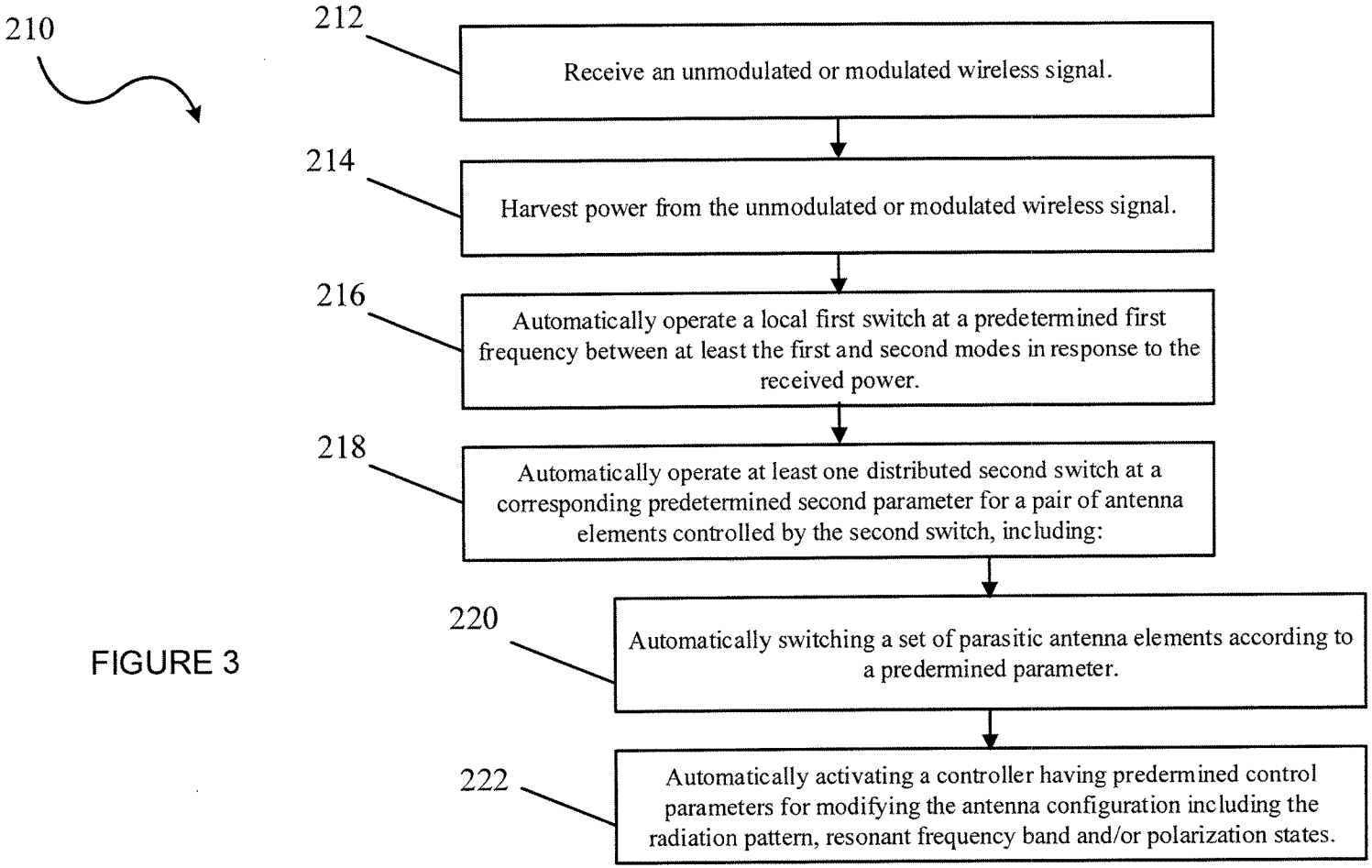
FIG. 3 illustrates a method for redirecting an antenna radiation pattern of an antenna device based on features of the antenna devices described herein.

Referring now to FIG. 3, a method 210 is generally shown for redirecting an antenna radiation pattern of an antenna device, such as antenna devices 110 and 210 discussed above along with FIGS. 1 and 2. As shown in FIG. 3, method 210 includes a step 212 of receiving a modulated or unmodulated wireless signal and a related step 214 of harvesting power from the modulated or unmodulated wireless signal. The method 210 continues with step 216 of automatically operating a local first switch at a predetermined first period between on and off modes in response to receiving power from a wireless signal. Next, method 210 includes the step 218 of automatically operating at least one distributed second switch at a corresponding predetermined second parameter for a pair of antenna elements controlled by the second switch.

Further, method 210 describes at least three dependent steps for controlling the second switch, which are generally alternative method control steps related to the second step based on the type of antenna elements controlled by the second switch and the manner in which they are controlled. As such, step 220 describes automatically switching a set of parasitic antenna elements according to a predetermined parameter, which would be appropriate for the antenna device shown in FIG. 2. Likewise, step 222 describes automatically activating a controller having predetermined control parameters for modifying the antenna configuration including the radiation pattern, resonant frequency band and/or polarization states, which would be appropriate for the antenna device shown in FIGS. 4-5 and discussed hereafter.

Figure 4:
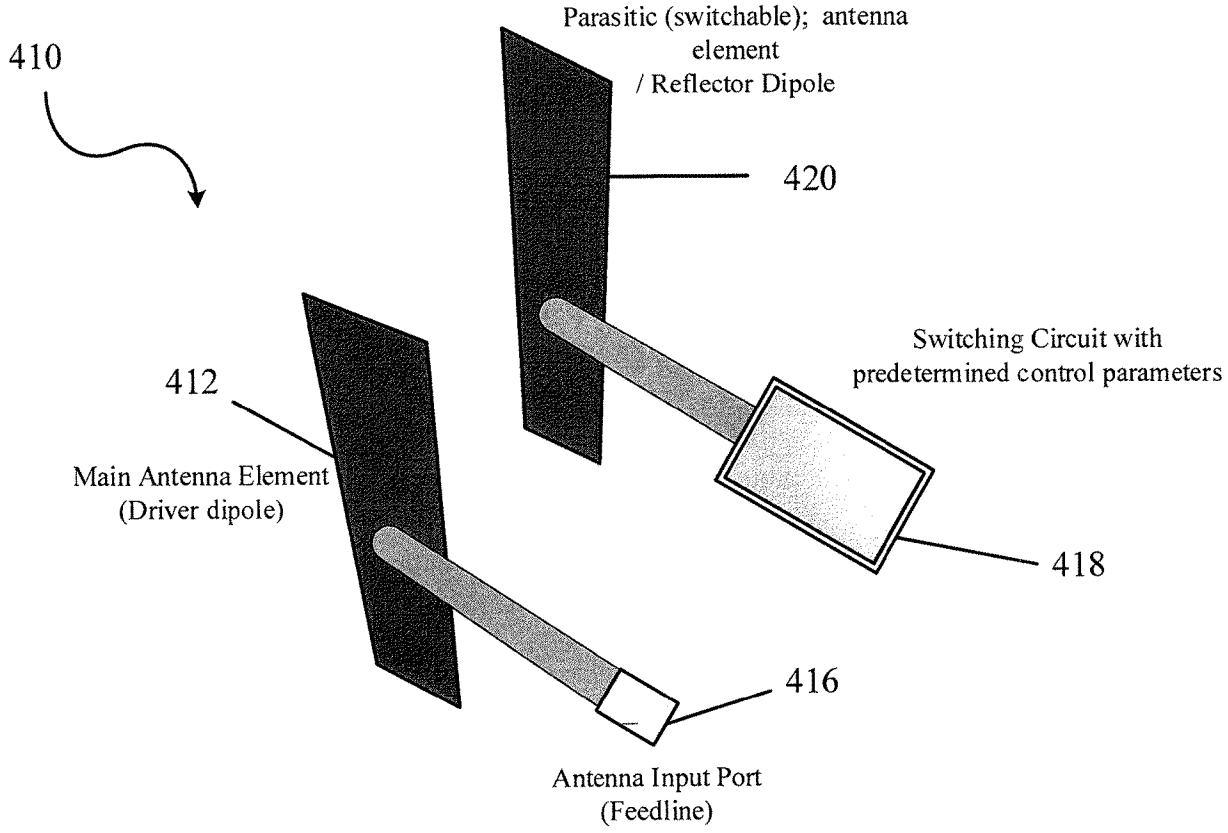
FIG. 4 shows yet another example antenna device having a different configuration from the devices of FIGS. 1 and 2.
Figure 5:
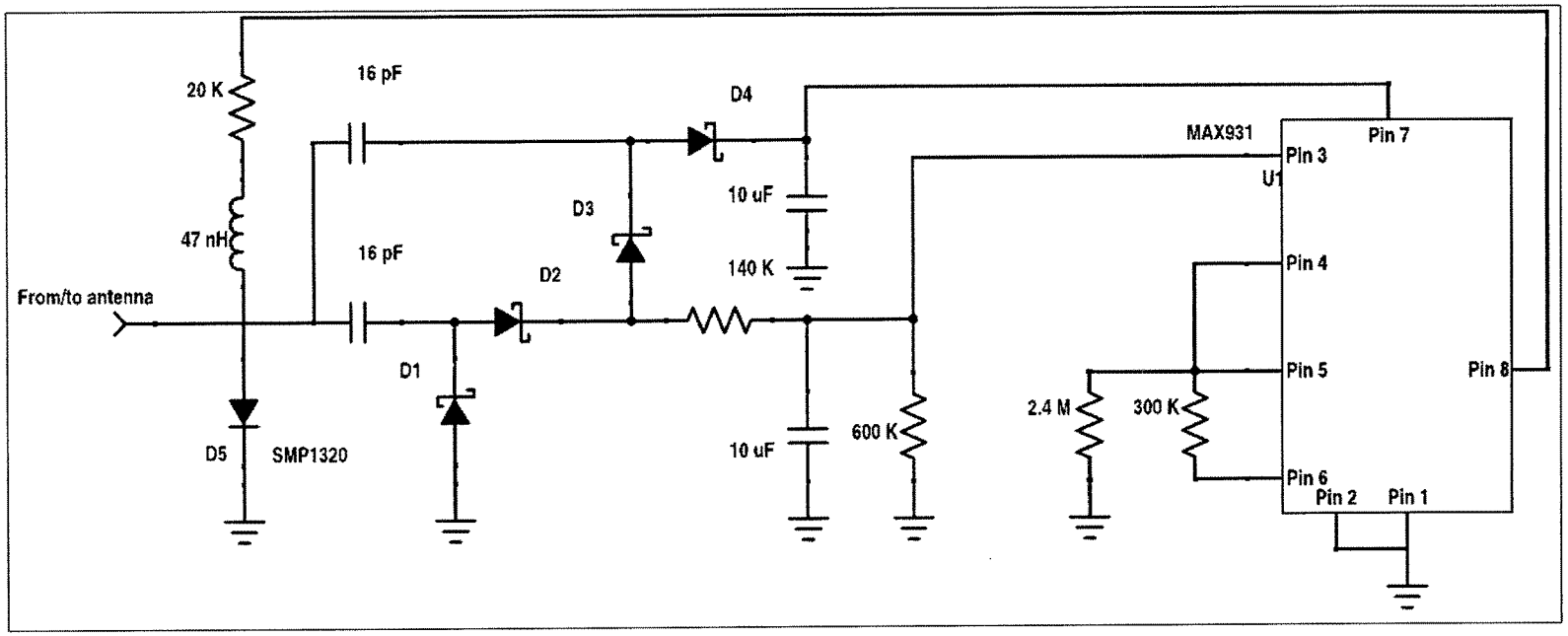
FIG. 5 illustrates a circuit for use with the antenna device of FIG. 4.

Referring now to FIGS. 4-5, an implementation of an antenna device 410 is shown in FIG. 4 along with a specific circuit diagram in FIG. 5 that corresponds to the antenna device of FIG. 4. FIGS. 4-5 show a 950 MHz antenna device having two dipoles including a driver dipole 412 attached to input port 416, and a parasitic element or reflector dipole 420 attached to custom switching circuit 418. The driver dipole is driven by a 20 dBm, 950 MHz unmodulated radio-frequency (RF) constant waveform (CW) source originating from an AGILENT signal generator.

The corresponding circuit schematic is shown in FIG. 5, according to one embodiment. As shown in FIGS. 4-5, the RF-to-DC converter output charges the 10-uF capacitor via 140 K resistor and powers the comparator, set with hysteresis. When the voltage on the capacitor exceeds the threshold, the comparator trips and turns on the PIN diode, which shorts the RF input port and greatly reducing the RF power into RF-to-DC converter. The capacitor starts discharging thereafter, the comparator trips back, and the cycle repeats. Thus this self-powered circuit oscillates and modulates its RF input port (connected to the reflector dipole), which essentially shorts and opens the dipole terminals.

Figure 6:
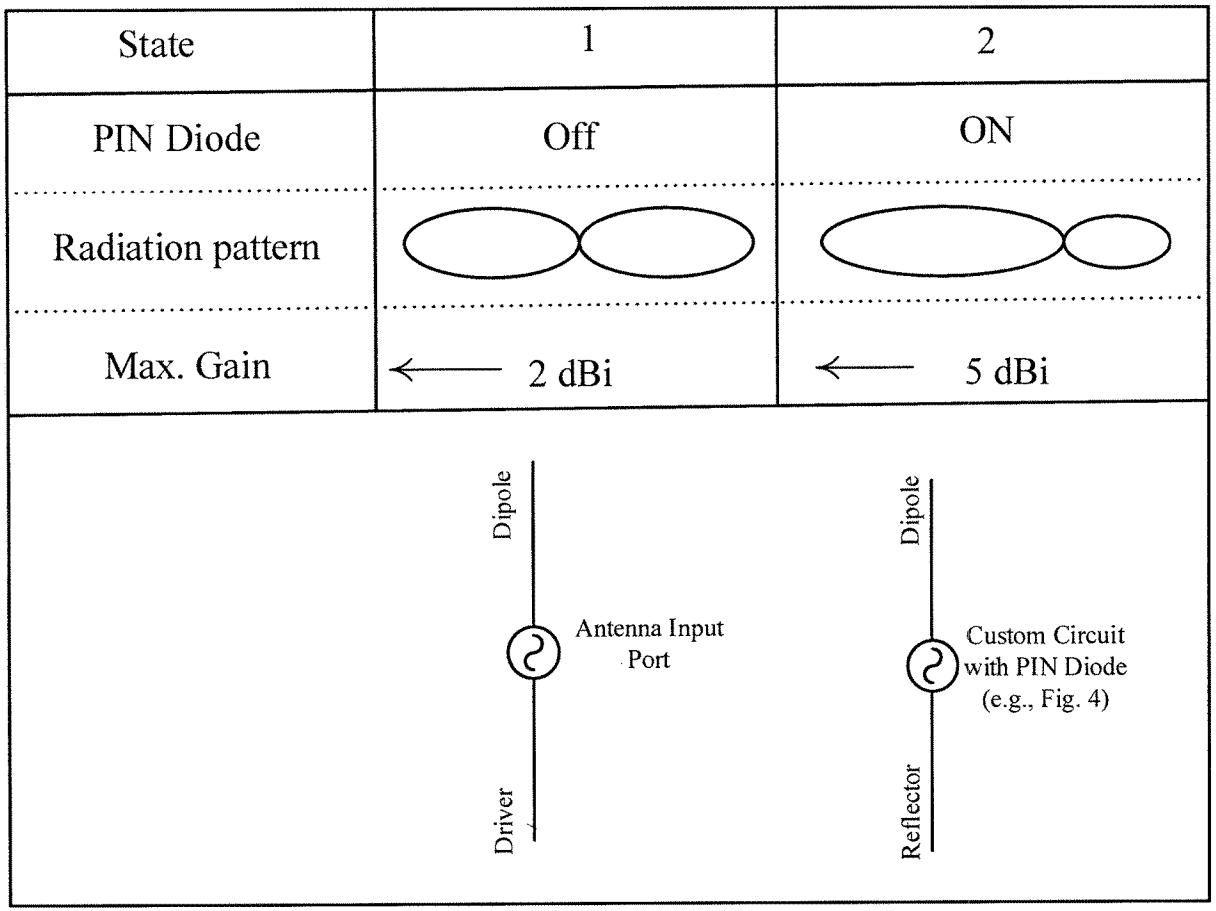
FIG. 6 shows a comparison of features and benefits provided by the antenna devices discussed along with FIGS. 1, 2 and 4.

The modulation frequency can be manually changed my modifying the values of the variable resistor and capacitor in the circuit described above. As a result, the antenna radiation pattern switches between two states (two patterns) as shown in FIG. 6. Operations of the antenna device 410 and corresponding circuit shown in FIGS. 4-5 were confirmed via physical observations of a test device corresponding to the antenna device of FIGS. 4-5. In addition to physical observation of the device during use, operations of a RF power sensor tag with LED sensors confirmed its operations including periodic illumination of LEDs on the test device for the appropriate periods and durations according to anticipated operations of the antenna device.

It is understood that additional antenna elements could be combined with the main first switch and the second switch controlling antenna elements as described above along with FIGS. 4-5, which could provide antenna devices having even more parameter options during use. For example, a third parasitic antenna element (e.g., a dipole having its own oscillating circuit that oscillates at a different period than the one described along with FIGS. 4-5 could be added to the antenna device, which may provide even more potential operating states depending on the frequencies. If the period of the third parasitic element were twice as long as the period of the first circuit, then the antenna would double its cycle and sequentially rotate through all four possible states (i.e., four because each of the two switching circuits has two states).

In addition, it is understood that aspects, features and benefits of the invention described herein are not unique applicable to, nor limited to, RFID networks, systems or devices. Many possibilities for implementing aspects and features of the invention described herein with other types of antenna devices and systems are possible.

Further, implementations with other types of antenna devices are highly likely due to many different properties and parameters of other types of antennas being possible, such as predetermined parameters for antenna patterns, polarizations, and frequency bands that could be implemented without adding any DC bias lines or DC biased feeds to operate the switches. For instance, aspects described herein could be used with various types of antennas including log periodic antennas and PCB antennas such as antennas known as YAGI antennas.

Further, it is understood that implementations of antenna devices and antenna device systems according to aspects and features of the invention are applicable to numerous and different types of technologies, industries, and devices. For example, an additional implementation not specifically discussed above can include repeatedly cycling through several operational states related to a Wi-Fi access point antenna in a building, such as mounted in a corner of a room, which can be configured to automatically and periodically "scan" the room based on aspects and features of the invention to steering its high gain beam in several possible directions. In another example possible implementation, implementations of aspects and features of the invention with reconfigurable antennas in an aircraft may be especially valuable for aircraft applications due to the lack of a requirement to provide antenna devices with external power.

These and other changes can be made to the invention in light of the above Detailed Description. While the above description describes certain examples, and describes the best mode contemplated, no matter how detailed the above appears in text, the invention can be practiced in many ways. Details of the system may vary considerably in its specific implementation, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

While certain aspects of the invention are presented below in certain claim forms, the applicant contemplates the various aspects of the invention in any number of claim forms.

The flowcharts and block diagrams in the Figures illustrate the architecture, functionality, and operation of possible implementations of systems and methods according to various embodiments. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems which perform the specified functions or acts, or combinations of special purpose hardware.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description has been presented for purposes of illustration and description, but is not intended to be exhaustive or limited to embodiments of the invention in the form disclosed. Many modifications and variations will be apparent to those of ordinary skill in the art without departing from the scope and spirit of embodiments. The embodiment was chosen and described in order to explain the principles of embodiments and the practical application, and to enable others of ordinary skill in the art to understand embodiments of the invention for various embodiments with various modifications as are suited to the particular use contemplated.

Although specific embodiments have been illustrated and described herein, those of ordinary skill in the art appreciate that any arrangement which is calculated to achieve the same purpose may be substituted for the specific embodiments shown and that embodiments have other applications in other environments. This application is intended to cover any adaptations or variations of the present invention. The following claims are in no way intended to limit the scope of embodiments of the invention to the specific embodiments described herein.

What is claimed is:

1. A passive, self-configurable antenna device, comprising:

at least one antenna element, comprising a first antenna and a second antenna, the first antenna configured to receive a modulated or an unmodulated wireless signal;

a power harvester configured to obtain power from the modulated or the unmodulated wireless signal; and a first switch coupled to the power harvester and powered by the obtained power from the power harvester, the first switch being configured to operate automatically when receiving the obtained power without requiring receipt of control information;

wherein the first switch connects the first antenna and the second antenna when turned on, and wherein the first switch automatically operates according to a predetermined pattern when receiving the obtained power to modulate the at least one antenna element, and wherein the at least one antenna element radiates resonantly when the first switch is turned on.

2. The antenna device of claim 1, wherein the first antenna is an input dipole and the second antenna is a reflector dipole.

3. The antenna device of claim 1, further comprising:

a plurality of switchable antenna elements at least including:

a first switchable antenna element;

a second switchable antenna element; and a second switch powered by the received power when the first switch is switched to a second position and is unpowered when the first switch is switched to a first position, wherein the second switch is configured to switch automatically between at least the first switchable antenna element and the second switchable antenna element when powered.

4. The antenna device of claim 1, wherein the predetermined pattern of the first switch is manually adjustable according to a hardware configuration of the first switch.

5. The antenna device of claim 4, wherein the hardware configuration of the first switch includes manually adjustable variable capacitors configured to permit manual adjustment of the predetermined pattern.

6. The antenna device of claim 1, wherein the predetermined pattern of the first switch includes a plurality of predetermined patterns.

7. The antenna device of claim 6, wherein each of the plurality of predetermined patterns is associated with a different frequency of the modulated or unmodulated wireless signal.

8. The antenna device of claim 6, wherein each of the plurality of predetermined patterns is associated with a different input power level of the modulated or unmodulated wireless signal.

9. The antenna device of claim 1, wherein the at least one antenna element includes a plurality of antenna elements, the antenna device further comprising:

a second switch powered by the received power when the first switch is switched to a second position and is unpowered when the first switch is switched to a first position, the second switch being configured as a control module for automatically changing predetermined configurations of the plurality of antenna elements without requiring the receipt of control information.

10. The antenna device of claim 9, wherein the predetermined configurations include at least one of a plurality of radiation patterns, a plurality of resonant frequency bands, and a plurality of polarization states.

11. The antenna device of claim 9, further comprising a plurality of visual feedback elements, wherein each visual feedback element is associated with one of the predetermined configurations.

12. The antenna device of claim 11, wherein the plurality of visual feedback elements includes a plurality of LED lights powered by the received power, wherein an arrangement of one or more LED lights are configured to be activated for each of the predetermined configurations.

13. The antenna device of claim 1, wherein the first switch automatically operates according to a predetermined pattern when receiving the obtained power to modulate the antenna element, the predetermined pattern including being switched to a first position when unpowered and being switched between a plurality of secondary positions when powered.

14. A method for redirecting an antenna radiation pattern of an antenna device, the method comprising:

receiving a modulated or unmodulated wireless signal;

harvesting power from the modulated or the unmodulated wireless signal; and in response to harvesting power from the modulated or the unmodulated wireless signal, automatically operating a first switch without requiring receipt of control information;

wherein automatically operating the first switch includes connecting a first antenna to a second antenna when turned on, wherein the second antenna redirects the antenna radiation pattern using at least one of a plurality of switchable elements.

15. The method of claim 14, wherein the first antenna is an input dipole and the second antenna is a reflector dipole.

16. The method of claim 14, further comprising:

providing harvested power to a second switch when the first switch is switched to the second position without providing harvested power to the second switch when the first switch is switched to the first position; and operating the second switch to switch automatically between connecting to a first switchable antenna element and connecting to a second switchable antenna element from the plurality of the switchable antenna elements.

17. The method of claim 14, further comprising:

modifying the predetermined pattern of the first switch including adjusting a hardware configuration of the first switch.

18. The method of claim 17, wherein adjusting the hardware configuration of the first switch includes adjusting variable capacitors.

19. The method of claim 14, wherein the predetermined pattern of the first switch includes a plurality of predetermined operating patterns, the method further comprising:

selecting a predetermined pattern of the plurality of predetermined patterns for switching the first switch based on the frequency of the modulated or unmodulated wireless signal received.

20. The method of claim 14, wherein the predetermined pattern of the first switch includes a plurality of predetermined patterns, the method further comprising:

selecting a predetermined pattern of the plurality of predetermined patterns for switching the first switch based on an input power level of the modulated or unmodulated wireless signal received.

* * * * *